US005927200A

United States Patent [19]

Chou et al.

[11] Patent Number: 5,927,200

[45] Date of Patent: Jul. 27, 1999

[54] HIGH-SHEAR LIQUID MIXING AND DISPERSING APPARATUS

[75] Inventors: Shem-Mong Chou, Westmont; Roehl Llanes, Naperville, both of Ill.

[73] Assignee: Goss Graphic Systems, Inc., Westmont, Ill.

[21] Appl. No.: 08/922,004

[22] Filed: Sep. 2, 1997

[51] Int. Cl.[6] ..... B41F 31/03; B41F 31/08

[52] U.S. Cl. ..... 101/364; 101/366

[58] Field of Search ..... 101/366, 363, 101/364, 350.1, 148, 147, 355, 356, 360, 361, 365; 210/710, 711, 407, 408; 366/342, 343, 344, 103, 104, 105, 168.1, 169.1, 170.2, 170.3

[56] References Cited

U.S. PATENT DOCUMENTS

| | | | |
|---|---|---|---|
| 782,277 | 2/1905 | Ruder . | |
| 1,001,508 | 8/1911 | Craig . | |
| 1,077,882 | 11/1913 | Holz . | |
| 1,771,321 | 7/1930 | Snow . | |
| 3,138,167 | 6/1964 | Fisher | 134/145 |
| 3,638,917 | 2/1972 | Osten | 259/2 |
| 3,669,900 | 6/1972 | Cummings . | |
| 4,388,864 | 6/1983 | Warner | 101/148 |
| 4,523,854 | 6/1985 | Beckley | 366/132 |
| 4,571,092 | 2/1986 | Switall | 366/348 |
| 4,814,376 | 3/1989 | Tanaka et al. | 524/588 |
| 5,144,892 | 9/1992 | Tupek et al. | 101/363 |
| 5,370,824 | 12/1994 | Nagano et al. | 252/314 |
| 5,403,494 | 4/1995 | Cain | 210/710 |
| 5,511,877 | 4/1996 | King | 366/169.2 |
| 5,665,796 | 9/1997 | Hosokawa et al. | 523/322 |

FOREIGN PATENT DOCUMENTS

| | | |
|---|---|---|
| 0 309 681 | 4/1989 | European Pat. Off. . |
| 0 355 590 | 2/1990 | European Pat. Off. . |
| 0 071 108 | 2/1993 | European Pat. Off. . |
| 23 57 212 A1 | 5/1975 | Germany . |
| 25 20 909 | 12/1975 | Germany . |
| 27 02 183 A1 | 7/1978 | Germany . |
| 33 19 921 A1 | 12/1984 | Germany . |
| WO 96/03203 | 2/1996 | WIPO . |

OTHER PUBLICATIONS

PCT International Search Report, International Application No. PCT/US98/18205, filed Sep. 2, 1998.

TAGA Proceedings, "Theoretical and Practical Aspects of Single Fluid Lithography", Chou et al., pp. 121–139, 1995.

*Primary Examiner*—J. Reed Fisher

*Attorney, Agent, or Firm*—Marshall, O'Toole, Gerstein, Murray & Borun

[57] ABSTRACT

A mixing and dispersing apparatus for emulsion ink in a printing press is disclosed. The apparatus includes a vessel having walls defining an upper chamber and a lower chamber. A motor drives a shaft carrying a propeller having pitched blades, disposed in the upper chamber. The shaft also carries a rotor disposed below the propeller. The rotor includes downwardly extending teeth that are disposed adjacent to inner and outer stator walls. The inner and outer stator walls are perforated by slots therein and are fixed with respect to the vessel. The propeller mixes ink and fountain solution and propels the mixture downward toward the rotor, which shears and disperses the ink and fountain solution into the lower chamber, forming a suitably stable emulsion ink. The emulsion ink is then pumped to an ink distribution rail for use of some of the emulsion ink for printing, with the remainder of the emulsion ink being recirculated to the mixing and dispersing apparatus.

9 Claims, 5 Drawing Sheets

FIG. 4
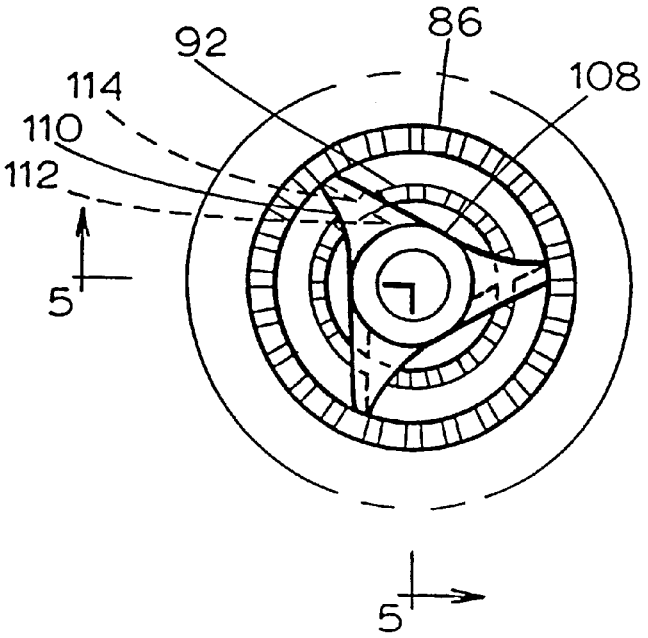
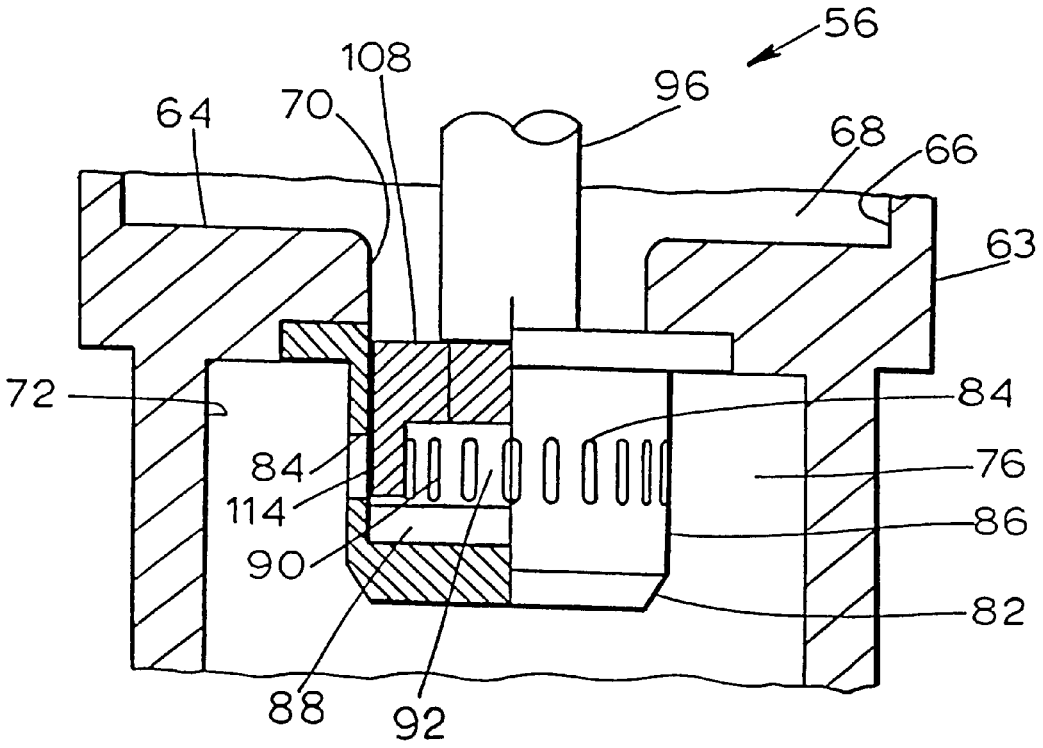
FIG. 5

HIGH-SHEAR LIQUID MIXING AND DISPERSING APPARATUS

FIELD OF THE INVENTION

The present invention is generally related to an apparatus for forming a stable liquid emulsion and, more particularly, an emulsion ink mixing and dispersing apparatus for a printing press.

BACKGROUND OF THE INVENTION

Emulsion inks used in lithography are made from an emulsion of an oil-based ink solution and a water-based fountain solution. The emulsion is applied to a printing plate (typically mounted to a plate cylinder) having distinct image areas and non-image areas. The image areas have an oleophilic material, such as an oleophilic polymer, disposed on the surface thereof, so that the oil-based ink solution will adhere thereto for subsequent transfer to a printing substrate, such as a paper web. The non-image areas have a hydrophilic material, such as an aluminum oxide, disposed on the surface thereof, so that the water-based fountain solution will adhere thereto, thereby forming a protective film over the non-image areas, to prevent ink from adhering thereto. A principal advantage of the use of emulsion inks is that emulsion inks can eliminate the need for a separate system to dampen the printing plate and hence the use of emulsion inks eliminates printing problems associated with keeping the ink and water properly in balance. Also, using emulsion inks simplifies the printing process by eliminating the need for many ink keys that would otherwise be required in presses using separate dampening and inking systems, i.e., to account for variations in image density.

However, a major drawback of the use of emulsion inks is that emulsion inks are often unstable (i.e. the oil-based ink and water-based fountain solution separate into distinct liquid layers). Such instability is undesirable because it interferes with ink transfer. For example, if the emulsion ink is not stable enough, the oil-based ink and water-based fountain solution will separate prematurely, before reaching the printing plate, resulting in scumming and wash marks, as water released from the emulsion ink will interfere with ink transfer by flushing across image areas of the printing plate. However, if the emulsion is overly stable, it will (a) not release a sufficient amount of water to the printing plate to keep the non-image areas of the printing plate free of ink and/or (b) reduce the amount of emulsion ink fed to the printing plate. Accordingly, the emulsion ink is formulated to have a stability that is within a "window" between being too stable and too unstable for satisfactory lithographic printing. It has been found that suitable emulsion inks have a water content of at least 25% by weight.

Also, because the viscosity of lithographic inks is relatively high, about 10 to a few hundred poises, lithographic inks generally do not flow freely. As water is dispersed into a matrix of lithographic ink to produce emulsion inks, the flow properties further deteriorate, making the formation of a suitably stable emulsion ink difficult.

SUMMARY OF THE INVENTION

It is an object of the present invention to provide an apparatus for properly emulsifying a water-based liquid into an oil-based liquid. Specifically, it is an object of the present invention to provide an apparatus for mixing and dispersing an emulsion ink for lithographic printing.

In accordance with one aspect of the present invention, a liquid mixing and dispersing apparatus comprises a vessel having walls defining a chamber. An elongated rotatable shaft is disposed in the chamber. The apparatus further includes a mechanism for rotating the shaft, a mechanism associated with the shaft for mixing and propelling liquid, and a mechanism associated with the shaft for shearing and dispersing liquid.

Other objects, advantages, and features of the present invention will become apparent from a consideration of the following specification taken in conjunction with the accompanying drawings.

BRIEF DESCRIPTION OF THE DRAWINGS

FIG. 4 is a plan view showing a rotor, an inner stator member, and an outer stator member forming part of the liquid mixing and dispersing apparatus;

FIG. 5 is a fragmentary side elevational view showing the rotor, the inner stator member, and the outer stator member, partially in cross-section taken generally along lines 5—5 of FIG. 4.

DETAILED DESCRIPTION OF THE PREFERRED EMBODIMENTS

Figure 1:
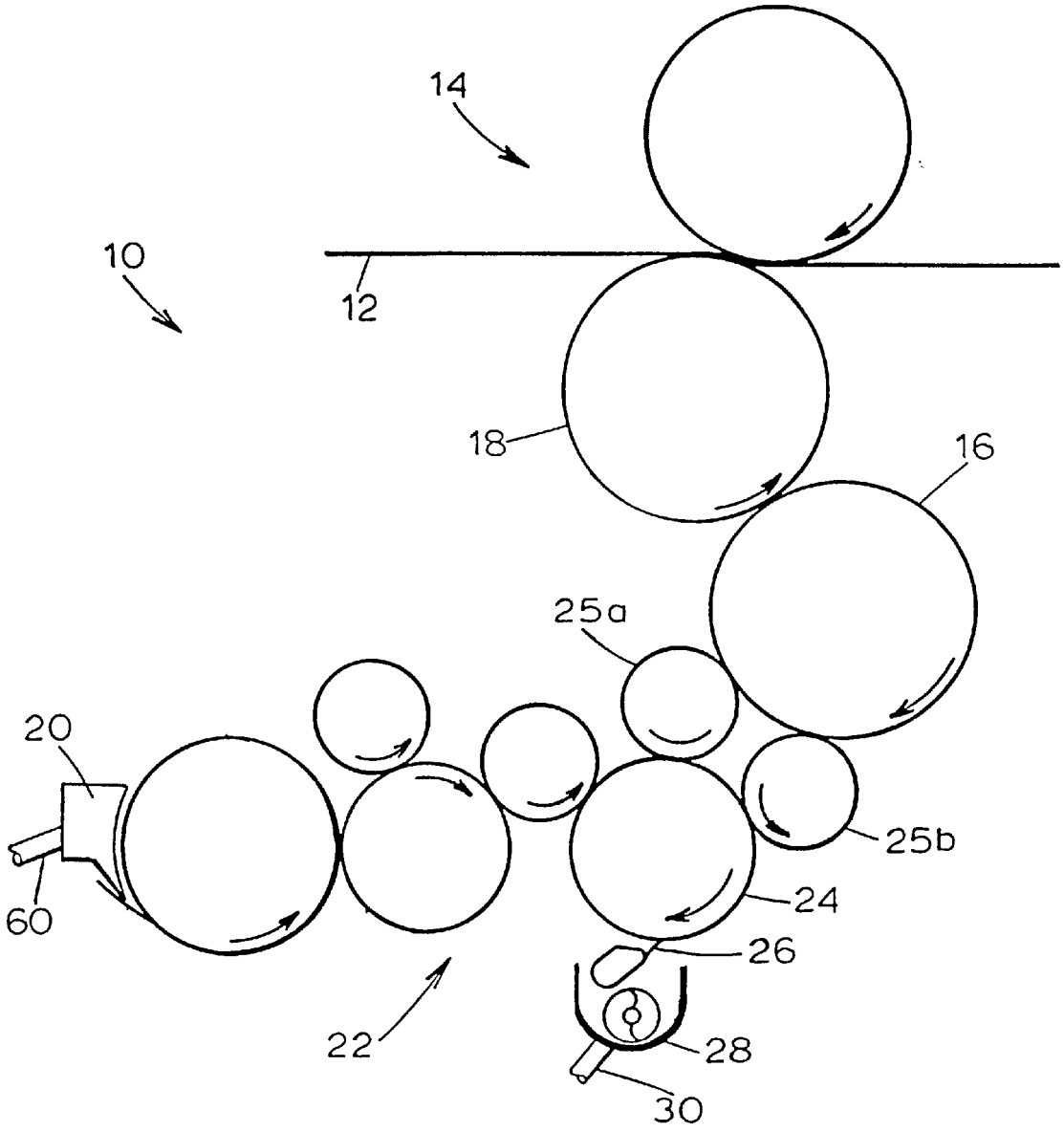
FIG. 1 is a schematic diagrammatic view of a printing press incorporating an emulsion ink mixing and dispersing apparatus in accordance with the present invention.

In the illustrations given, and with reference first to FIG. 1, there is shown a printing press generally designated 10 for printing an image on a paper web 12. The press 10 has a printing unit 14 for printing ink on the web 12. Although not shown, the press 10 may include one or more additional printing units that may each be used, for example, for printing a different color of ink on the web 12.

The printing unit 14 has a plate cylinder 16 associated with a blanket cylinder 18. During printing by the press 10, an image of the ink is transferred from the plate cylinder 16 to the blanket cylinder 18 to print the image on one surface of the web 12. An emulsion ink, made up of an oil-based ink and a water-based fountain solution, is fed to the plate cylinder 16 from a digitally-controlled gear pump ink injector 20 through a plurality of distribution rollers 22, a main ink drum 24, and a pair of form rollers 25*a* and 25*b*. The main ink drum 24 collects excess emulsion ink that is in turn scraped off of the main ink drum 24 by a doctor blade 26 and collected for reuse by an auger and scraper assembly 28, forming part of an ink feed and recirculation system 29, shown schematically in FIG. 2.

Figure 2:
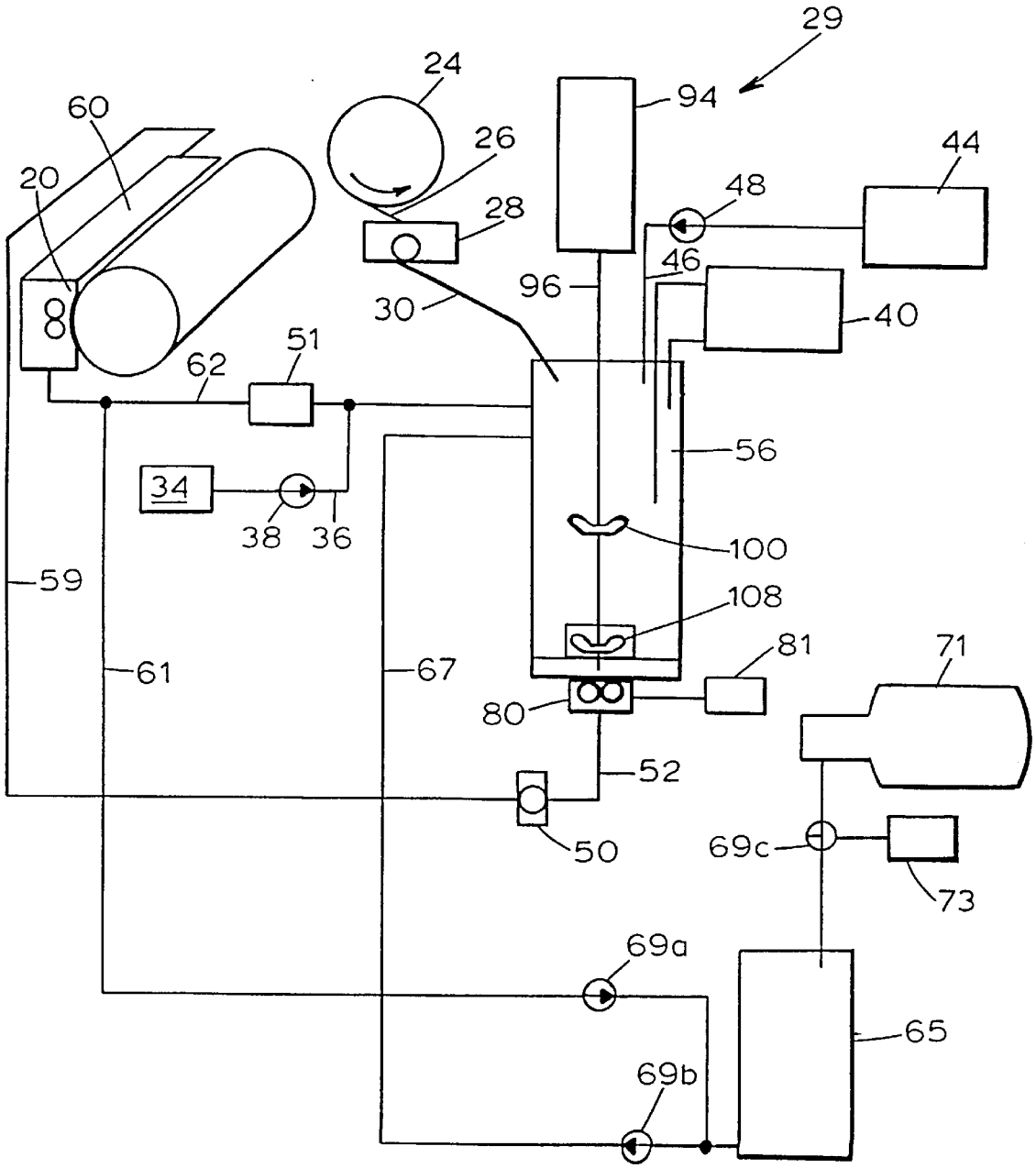
FIG. 2 is a schematic diagrammatic view of a feed and recirculation system for the ink in the printing press of FIG. 1.

With reference to FIG. 2, the collected excess ink is transported by the auger and scraper assembly 28 to a conduit 30 which feeds a mixing and dispersing apparatus 56. Fresh ink is fed to the mixing and dispersing apparatus 56 from an ink supply reservoir 34 through a conduit 36. The flow of fresh ink through the conduit 36 is controlled by a valve 38 that is responsive to a liquid level sensor 40 that senses the level of liquid in the mixing and dispersing apparatus 56. If the liquid level sensor 40 determines an overflow level of liquid, emulsion ink via conduit 62 is diverted to a conduit 61 and into an auxiliary reservoir 65.

Liquid from the auxiliary reservoir 65 may be used again by feeding it back to the mixing and dispersing apparatus 56 via a conduit 67. Liquid discharge into or out of the auxiliary reservoir 65 is controlled via solenoid valves 69*a*, 69*b*, and 69*c* and by air depressurizing (discharge into) or air pressurizing (discharge out of) the auxiliary reservoir 65. The solenoid valve 69*c* can connect the auxiliary reservoir 65 to either a shop air system 71, providing air pressure of from about 40 psi (about 276 KPa) to about 70 psi (about 483 KPa), for pressurizing the auxiliary reservoir 65, or a vacuum source 73, providing air at a pressure of from about 0 to about 10 psi (about 69 KPa), for depressurizing the auxiliary reservoir 65.

Fresh fountain solution is fed to the mixing and dispersing apparatus 56 from a fountain solution supply reservoir 44 through a conduit 46. The flow of fresh fountain solution through the conduit 46 is controlled by a valve 48 that is responsive to a water content sensor 50 that senses the percentage of water flowing out of the mixing and dispersing apparatus 56 in an outlet conduit 52. The emulsion ink is fed to an ink distribution rail 60 via a conduit 59. The ink distribution rail 60 in turn feeds the digitally-controlled gear pump ink injector 20. Unused emulsion ink is continuously recirculated to the mixing and dispersing apparatus 56 via the return conduit 62. This recirculation via the return conduit 62 is in addition to the ink scraped off of the main ink drum 24 and returned to the mixing and dispersing apparatus 56 via the conduit 30.

A pressure regulator 51 ensures that the pressure in the conduit 62 is between about 10 psi (about 69 KPa) and about 20 psi (about 138 KPa). The pressure regulator 51 ensures that there is adequate pressure in the ink distribution rail 60 for preventing air entrainment into the ink emulsion and that there is adequate pressure for filling the auxiliary reservoir 65, when necessary.

Figure 3:
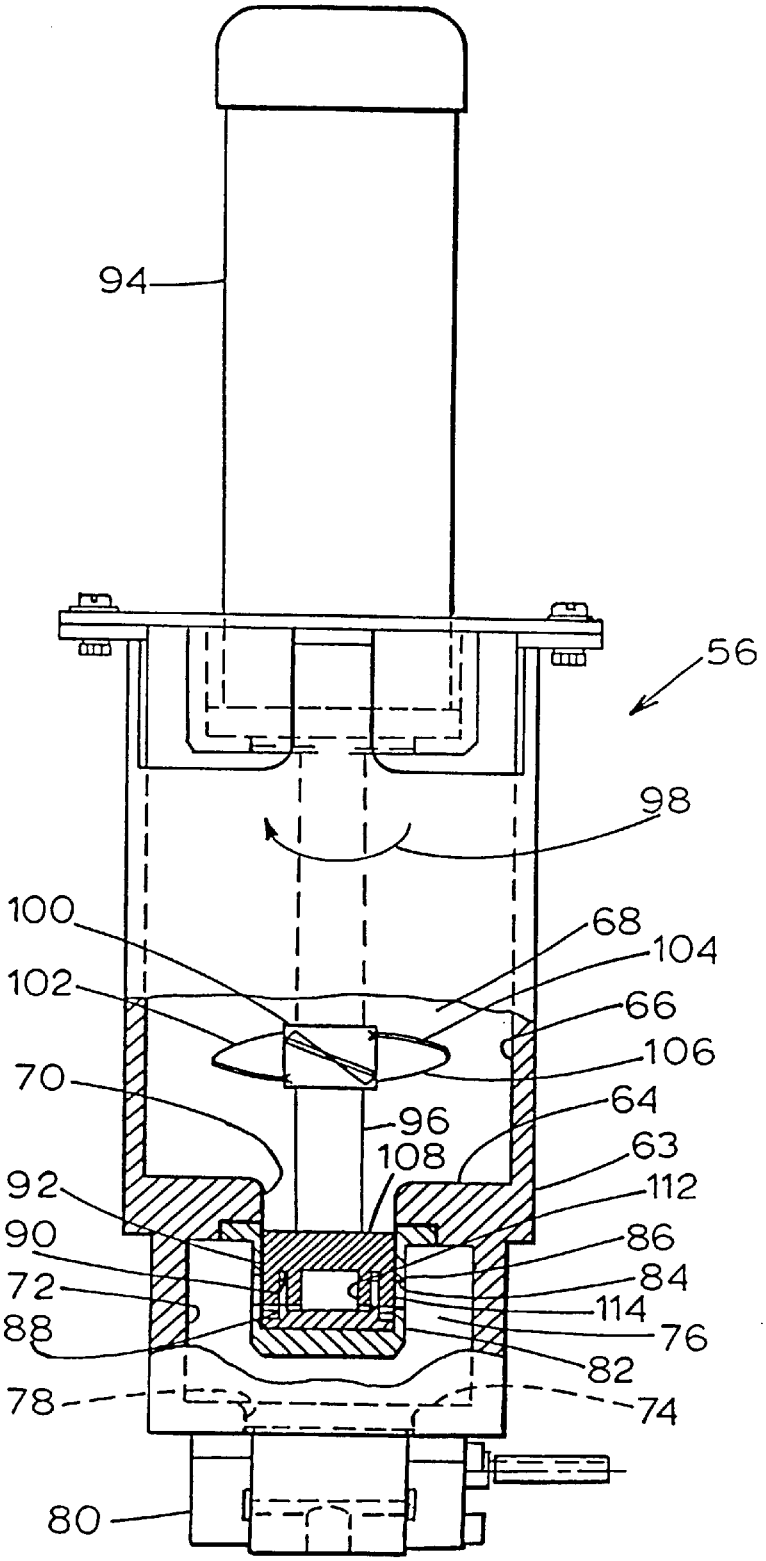
FIG. 3 is a side elevational view, partially in cross-section, of the liquid mixing and dispersing apparatus in accordance with the present invention.

With reference to FIGS. 3 and 5, the mixing and dispersing apparatus 56 includes a vessel 63 comprising a first circular horizontal wall 64, and a cylindrically-shaped upper vertical wall 66 having a height of about 21.0 cm and an inner diameter of about 17.8 cm, that together define a cylindrically-shaped upper chamber 68.

The first horizontal wall 64 has a circular opening 70 therein having a diameter of about 6.4 cm. The vessel 63 also includes a cylindrically-shaped lower vertical wall 72 having an inner diameter of about 13.8 cm, that is disposed directly below the first horizontal wall 64. The first horizontal wall 64, the cylindrically-shaped lower vertical wall 72, and a second circular horizontal wall 74, together define a cylindrically-shaped lower chamber 76. The second circular horizontal wall 74 has a substantially square-shaped opening 78 therein, having dimensions of about 8.0 by 8.0 cm, that leads to a gear pump 80, driven by a gear pump motor 81 (FIG. 2), that pumps emulsion ink out of the lower chamber 76.

A cup-shaped outer stator 82 is fixedly attached to the first horizontal wall 64 and is perforated by twenty four vertical slots 84 evenly distributed about an outer stator cylindrical wall 86, having a wall thickness of about 4.8 mm. A cup-shaped inner stator 88 is fixedly attached to the outer stator 82 and is perforated by sixteen vertical slots 90 evenly distributed about an inner stator cylindrical wall 92, having a wall thickness of about 4.0 mm. Each of the slots 84 and 90 has a height of about 15.9 mm and a width of about 3.4 mm.

A high-speed electric motor 94 is disposed above the upper chamber 68 and drives a motor shaft 96 in a clockwise direction as viewed from above, as indicated by an arrow 98. A propeller 100 is mounted to the motor shaft 96 for rotation therewith and comprises three propeller blades 102 equally angularly spaced apart from one another by 120 degrees and each pitched by an angle of about 20 degrees with respect to the horizontal such that a leading edge 104 of each propeller blade 102 is above a respective trailing edge 106 of each propeller blade 102. The propeller 100 has a diameter of about 12.7 cm and is mounted to the motor shaft 96 in the upper chamber 68 at a location that is preferably between one half to one full propeller diameter above the first horizontal wall 64.

Figure 6:
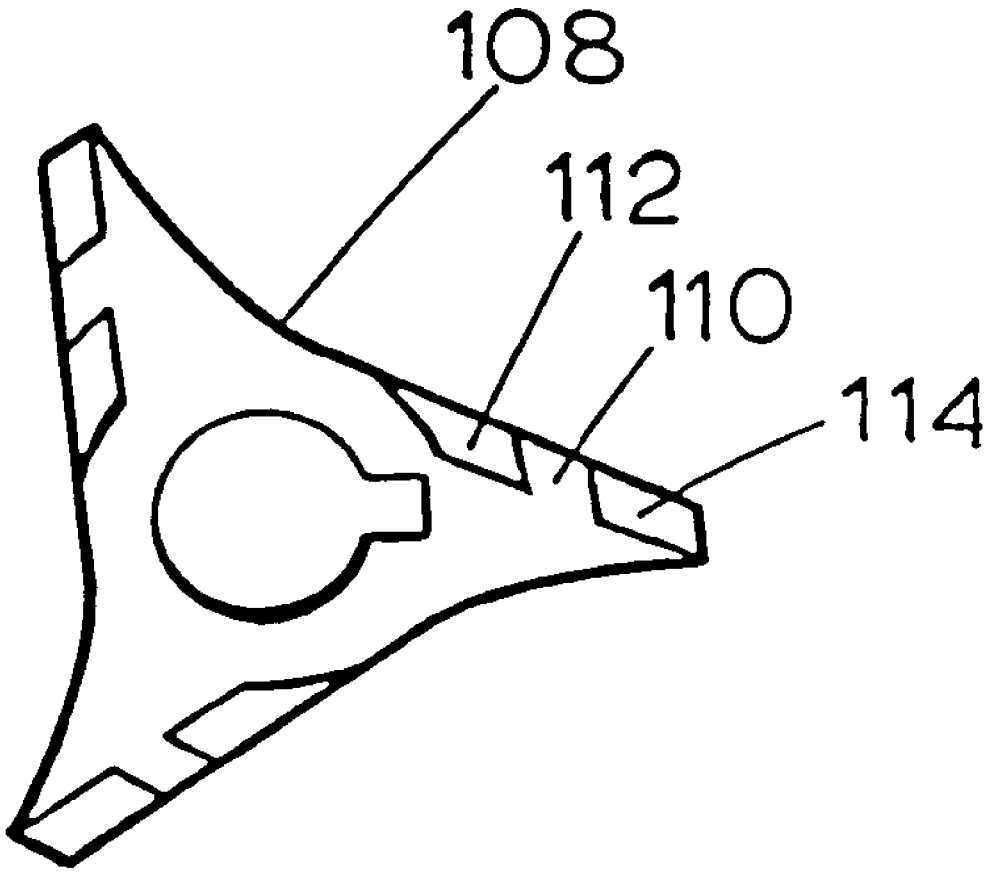
FIG. 6 is an elevational view, taken from below, showing the rotor.

A rotor 108 (best seen in FIGS. 4 and 6) is mounted to the lower end of the motor shaft 96 for rotation therewith. The rotor 108 includes three horizonal blades 110 that are equally angularly spaced apart from one another by 120 degrees. Each blade 110 includes a downwardly extending inner tooth 112 and a downwardly extending outer tooth 114. Each inner tooth 112 is disposed radially inwardly of the inner stator wall 92 and each outer tooth 114 is disposed between the inner stator wall 92 and the outer stator wall 86. A relatively close clearance of about 0.4 mm is provided between the teeth 112, 114 and the stator walls 86, 92.

In operation, the motor 94 is rotated at a speed of between about 500 and about 4,000 revolutions per minute, and the motor shaft 96, the rotor 108, and the propeller 100 rotate at the same speed as the motor 94. Due to the pitch of the propeller blades 102, the rotation of the propeller 100 causes the ink and fountain solution in the upper chamber 68 to mix together and to flow downwardly toward the rotor 108. The rotation of the rotor 108 shears the ink and fountain solution between the rotor teeth 112, 114 and the inner and outer stator walls 92 and 86. This shearing causes the formation of a fine emulsion ink that is dispersed through the slots 90 and 84 in the inner and outer stator walls 92 and 86 into the lower chamber 76. The emulsion ink is then pumped by the gear pump 80 to the conduit 57 (FIG. 2).

The propeller 100 pre-mixes the ink and fountain solution together and ensures that the fountain solution added to the upper chamber 68 does not simply sit on top of the ink surface and fail to mix with the ink matrix to form an emulsion ink having the desired water content. The propeller 100 also prevents a cavity from forming above the rotor 108, that would inhibit ink and fountain solution from flowing into the lower chamber 76.

While in the foregoing there has been set forth a preferred embodiment of the invention, it will be appreciated that the details herein given may be varied by those skilled in the art without departing from the true spirit and scope of the appended claims.

We claim:

1. A liquid mixing and dispersing apparatus comprising:

a vessel having walls defining a chamber;

an elongated rotatable shaft in the chamber;

means for rotating the shaft;

means associated with the shaft for mixing and propelling liquid;

means associated with the shaft for shearing and dispersing liquid, said shearing and dispersing means including a rotor having a plurality of rotor blades, an inner rotor tooth and an outer rotor tooth, radially spaced from one another, extending from each rotor blade; and an inner stator member, fixedly attached to the vessel and including a cylindrical inner stator wall disposed radially intermediate of the inner rotor teeth and the outer rotor teeth.

2. The apparatus of claim 1, wherein the inner stator wall is perforated.

3. The apparatus of claim 1, further including an outer stator member, fixedly attached to the vessel and including a cylindrical outer stator wall disposed radially outwardly of the outer rotor teeth.

4. The apparatus of claim 3, wherein the outer stator wall is perforated.

5. An emulsion ink mixing and dispersing apparatus for a printing press, the apparatus comprising;

a vessel having walls defining an upper chamber and a lower chamber;

an elongated rotatable shaft in the upper chamber;

means for rotating the shaft;

means associated with the shaft for propelling liquid; and means associated with the shaft for shearing and dispersing liquid, said shearing and dispersing means comprising a rotor disposed in the lower chamber that includes a plurality of rotor blades, said plurality of rotor blades including an inner rotor tooth and an outer rotor tooth, radially spaced from one another, extending from each rotor blade; and an inner stator member, fixedly attached to the vessel and including a cylindrical inner stator wall disposed radially intermediate of the inner rotor teeth and the outer rotor teeth.

6. The apparatus of claim 5, wherein the inner stator wall is perforated.

7. The apparatus of claim 5, further including an outer stator member, fixedly attached to the vessel and including a cylindrical outer stator wall disposed radially outwardly of the outer rotor teeth.

8. The apparatus of claim 7, wherein the outer stator wall is perforated.

9. The apparatus of claim 8, wherein the perforations in the inner stator wall and the perforations in the outer stator wall provide a sole fluid path between the upper chamber and the lower chamber.

* * * * *